United States Patent [19]

Reisem

[11] 4,414,521

[45] Nov. 8, 1983

[54] LOW RELUCTANCE TRANSFORMER CORE

[75] Inventor: Daniel E. Reisem, Maplewood, Minn.

[73] Assignee: Minnesota Mining and Manufacturing Company, St. Paul, Minn.

[21] Appl. No.: 246,621

[22] Filed: Mar. 23, 1981

Related U.S. Application Data

[63] Continuation-in-part of Ser. No. 34,381, Apr. 30, 1979, Pat. No. 4,321,652.

[51] Int. Cl.[3] ..... H01F 3/00

[52] U.S. Cl. ..... 335/281; 335/297; 336/216

[58] Field of Search ..... 335/229, 234, 236, 304, 335/281, 297; 336/216

[56] References Cited

U.S. PATENT DOCUMENTS

| | | | |
|---|---|---|---|
| 1,934,467 | 11/1933 | Hopp | 335/281 X |
| 3,013,136 | 12/1961 | De Fligue | 335/281 |
| 3,050,663 | 8/1962 | Zipper | 335/251 |
| 3,158,712 | 11/1964 | De Fligue | 335/281 X |

FOREIGN PATENT DOCUMENTS

| | | | |
|---|---|---|---|
| 3008598 | 10/1981 | Fed. Rep. of Germany . | |
| 328215 | 4/1958 | Switzerland | 336/216 |

*Primary Examiner*—George Harris

*Attorney, Agent, or Firm*—Donald M. Sell; James A. Smith; William D. Bauer

[57] ABSTRACT

A low reluctance transformer core utilizing first and second members, each having a leg element tapered in opposite directions. The tapered leg elements have continuous tapered interfaces designed to cooperatively mate with a wedging action forming a low reluctance leg.

7 Claims, 3 Drawing Figures

LOW RELUCTANCE TRANSFORMER CORE

RELATED APPLICATION

This application is a continuation-in-part of U.S. Ser. No. 034,381, Baker et al, LOW VOLTAGE TRANSFORMER RELAY, filed Apr. 30, 1979 now U.S. Pat. No. 4,321,652.

BACKGROUND OF THE INVENTION

1. Field of the Invention

This invention relates generally to an electromagnetic device and specifically to a low voltage transformer relay.

2. Description of the Prior Art

Electromagnetic devices such as the magnetic remote control switch described in U.S. Pat. No. 3,461,354 to Bollmeier may be used to control high voltage, high current electrical loads by remotely located low voltage switches. This type of remote switching device is generically called a low voltage transformer relay.

One of the principle advantages of such low voltage transformer relays is the ability to control the electrical load by a multiplicity of low voltage switches located in various locations. For example, if a low voltage transformer relay is used to control a lighting load within a room, one or more low voltage switches located within the room as well as one or more remotely located low voltage switches may be used to control the load. Such a configuration allows one to extinguish all of the lights within a building from a single remote location having a low voltage circuit to each transformer relay.

There is a continuing need, however, to reduce the fabrication costs and improve the electrical and mechanical performance of such low voltage transformer relays.

SUMMARY OF THE INVENTION

A ferromagnetic core has a source of operating flux for establishing a magnetic field in the ferromagnetic core. The ferromagnetic core has a first member having first and second leg elements tapered in opposite directions and a second member having first and second leg elements tapered in opposite directions. The tapered leg elements have continuous tapered interfaces adapted to cooperatively mate with a wedging action forming low reluctance first and second legs.

The ferromagnetic core is constructed with the first and second leg elements of the first and second members having a coefficient of friction with respect to each other and with the continuous tapered interfaces of the first and second leg elements of the first member and the second member forming a taper angle. Preferably the value of the tangent of the taper angle is not more than the value of the coefficient of friction. In a preferred embodiment the taper angle is greater than zero and not more than thirty-five degrees, and still preferably the taper angle is approximately fifteen degrees.

The first leg of the ferromagnetic core may form the core for a primary winding while the second leg may form the core for a secondary winding. The primary winding may be adapted to be connected to a power source and the secondary winding may be connected to a rectifying switch where the rectifying switch may selectively control the direction of induced current in the winding for selectively establishing an operating flux.

As a consequence of the tapered leg geometry, the flux flowing between the individual elements of the first and second members is presented with an area much larger than the core leg cross-section. The tapered leg geometry also produces a wedging action when the first and second members are brought together creating a very small clearance or interface dimension. Both of these actions cooperate to lower the reluctance of the first and second legs and, in one embodiment, reduce the reluctance to one-half of the value of reluctance of a comparable butt or lap joint.

DESCRIPTION OF THE PREFERRED EMBODIMENT

Figure 1:
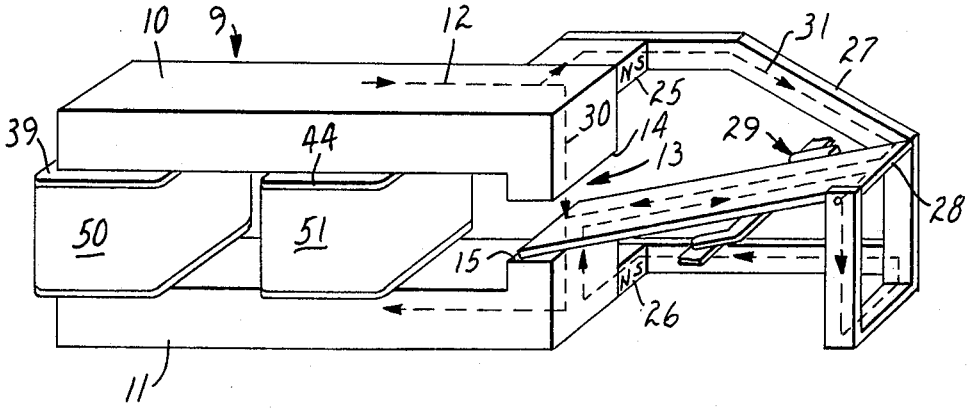
FIG. 1 is an isometric view of a low voltage transformer relay utilizing the ferromagnetic core of the present invention.

The low voltage transformer relay illustrated in FIG. 1 includes a core 9 having an upper core member 10 and a lower core member 11, a primary winding 50 formed on a spool structure 39, a secondary winding 51 formed on a spool structure 44, sources of latching flux 25 and 26, a flux return bracket 27 and an armature 28. The sources of the operating flux 12 are the primary winding 50 and the secondary winding 51. This operating flux is carried by the core 9. Sources of latching flux 25 and 26 are positioned between the ferromagnetic core 9 and the flux return bracket 27, one on either side of gap 13. Preferably the sources of latching flux 25 and 26 are permanent magnets, such as Plastiform flexible permanent magnets available from Minnesota Mining and Manufacturing Company, St. Paul, Minn. The source of operating flux and the source of latching flux generate magnetic flux conducted through core 9, flux return bracket 27 and armature 28, which activates a load switch 29, to form a magnetic circuit which will latch the armature to one of the pole faces 14 or 15.

The sources of latching flux (25 and 26) are positioned in the present invention and the core 9 is constructed to minimize total magnetic reluctance in the low voltage transformer relay.

Figure 2:
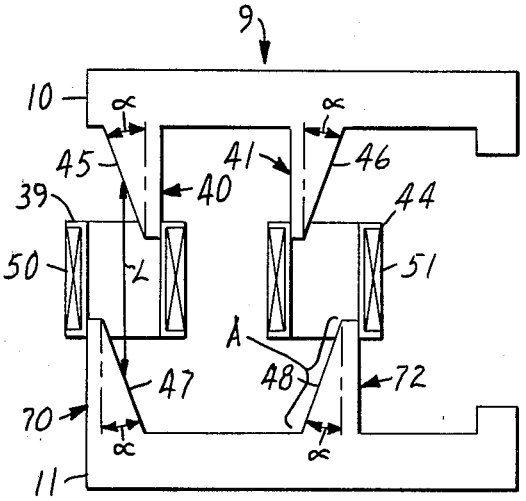
FIG. 2 is an exploded elevation view of the ferromagnetic core of the present invention.

To ensure that the reluctance of the ferromagnetic core 9 is low, a low reluctance core structure is utilized. As shown in FIG. 2, the ferromagnetic core 9 is formed from an upper core member 10 and a lower core member 11. The upper core member 10 has a first leg element 40 and a second leg element 41, each having one continuous tapered interface 45 and 46, respectively. Likewise, the lower core member 11 has a first leg element 70 and a second leg element 72, each having one continuous tapered interface 47 and 48, respectively, complementary to the tapered interfaces 45 and 46 of upper core member 10. The taper angle $\alpha$ is preferably less than 35°, and still preferably is approximately 15°. During assembly, the upper and lower core members are inserted into a spool structures 39 and 44 having hollow central portions for receiving the leg elements (40, 41, 70 and 72) and for receiving the primary winding 50 and the secondary winding 51. The interior dimension of the hollow portion of the spool structure 39 is smaller than the sum of the widths of the bases of first leg elements 40 and 70. Similarly, the interior dimension of the hollow portion of the spool structure 44 is smaller than the sum of the widths of the bases of the second leg elements 41 and 72. Insertion into the spool, therefore, forces the tapered faces 45, 46, 47, 48 into wedging contact. The first leg elements 40 and 70 of the upper and lower core members 10 and 11, respectively, together define a first leg; and the second leg elements 41 and 72 together define a second leg. This wedging action reduces the interface dimension L, the space between the mated tapered faces 45 and 47 and between the mated tapered faces 46 and 48, to a minimal value due to force amplification caused by the continuous tapered interfaces, and which locks the upper core member 10 and lower core member 11 together through frictional forces preventing any subsequent loosening and attendant increase in the interface dimension L. The taper angle $\alpha$ should be chosen such that the value of tangent of the taper angle $\alpha$ is not more than the value of the coefficient of friction between the continuous tapered interfaces 45 and 47 and between the continuous tapered interfaces 46 and 48. In some preferred embodiments the value of the taper angle $\alpha$ is from greater than zero to not more than thirty-five degrees. In one preferred embodiment, the taper angle $\alpha$ is approximately fifteen degrees. As a consequence of the geometry of this design the flux flowing between the upper and lower core members 10 and 11 is presented with an area A, along the continuous tapered interfaces 45, 46, 70 and 72, much larger than the core leg cross section. The wedging action of the spool structures 39 and 44 creates a very small clearance or interface dimension L. The effect is to minimize the factor L/A to which reluctance is directly proportional. This construction reduces the reluctance to one-half of the value of the prior art butt or lap joint construction.

Figure 3:
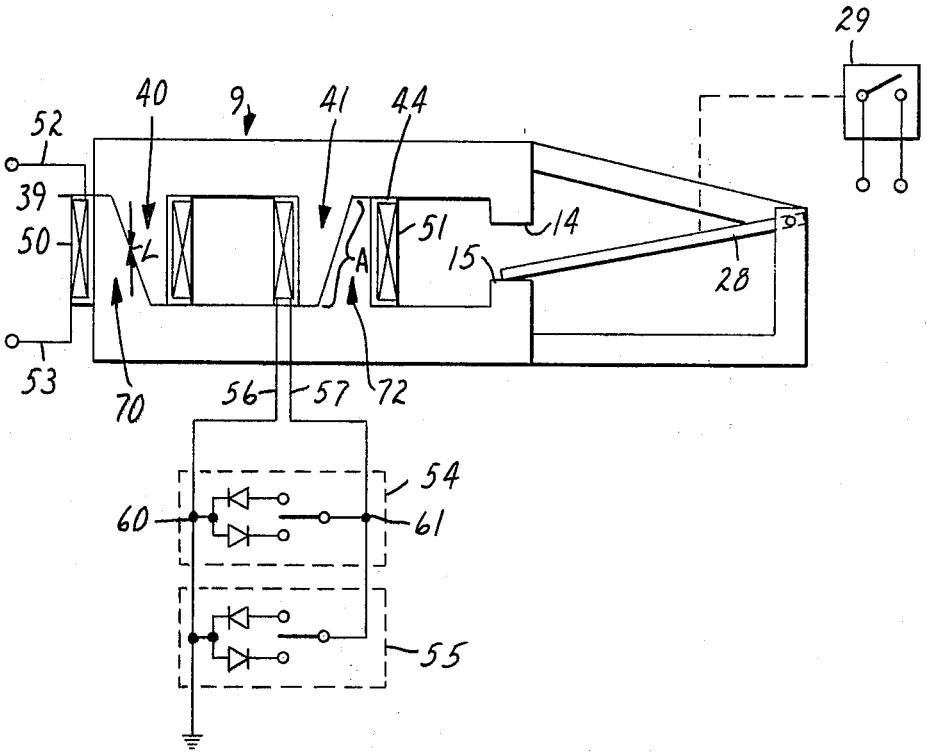
FIG. 3 is a cross-sectional elevation view of the low voltage transformer relay of FIG. 1, utilizing the ferromagnetic core of the present invention and including electrical connections.

In FIG. 3 the electrical connections to the low voltage transformer relay are shown. A primary winding 50 and a secondary winding 51 are wound on a spool structures 39 and 44, respectively. During assembly the spools are oriented such that the secondary winding 51 surrounds the second leg elements 41 and 72 of the core 9, and the primary winding 50 surrounds the first leg elements 40 and 70 of the core 9.

In operation the primary winding 50 is connected to a source of A.C. voltage through leads 52 and 53. The A.C. voltage across the primary winding 50 induces an A.C. voltage on the secondary winding 51.

Rectifying switches 54 and 55, are connected to the secondary winding through leads 56 and 57 which permits half wave current to flow in the secondary winding opposing the primary flux and resulting in operating flux appearing in the flux paths 30, 31 (shown in FIG. 1) of the device. The rectifying switches 54 and 55 include single pole double throw switches of the momentary contact type, and a pair of diodes. The cathode of one diode and the anode of the other diode of the pair of diodes associated with switch 54 are connected to one terminal 60 of the switch 54. The opposite ends of each diode are connected to the switched terminals of switch 54. The common terminal 61 of the switch 54 is connected to the secondary winding lead 57. The second switch 55 is connected similarly. In operation, the switches are used to selectively connect one of the diodes in series with the secondary winding. In this position, an electrical circuit is completed which allows the induced voltage in the secondary to establish an unidirectional current in the coil and a corresponding magnetic field in the core 9. This is the source of operating flux 12 (shown in FIG. 1) to transfer the armature 28. The two positions of the switches correspond to the two positions of the armature 28. As illustrated in FIG. 3, an arbitrary number of rectifier switches 54, 55 may be connected in parallel to control the low voltage transformer relay from a number of remote locations.

The armature 28 carries a pair of electrical contacts which cooperate with a pair of stationary contacts to form a load switch 29. When the armature 28 contacts pole face 15 it carries the contacts thereon into contact with the stationary contacts to complete an electrical circuit to a power a load. When rectifying switch 54 or 55 is momentarily moved to its off position the armature is moved to pole face 14 separating the contacts and disconnecting the power to the load.

What is claimed is:

1. A ferromagnetic core having a source of operating flux for establishing a magnetic field in said core, comprising:

a first member having first and second leg elements tapered in opposite directions; and a second member having first and second leg elements tapered in opposite directions;

said tapered leg elements each having a continuous tapered interface, said continuous tapered interface of said first member being oriented opposite to said continuous tapered interface of said second member, said continuous tapered interfaces adapted to cooperatively mate with a wedging action;

said first and second leg elements of said first member and said second member having a coefficient of friction with respect to each other, said continuous tapered interfaces of said first and second leg elements of said first member and said second member forming a taper angle, the value of the tangent of said taper angle being not more than the value of said coefficient of friction;

whereby low reluctance first and second legs are formed.

2. A ferromagnetic core as in claim 1 wherein said continuous tapered interfaces of said first and second leg elements of said first member and said second member form a taper angle of from greater than zero to not more than 35 degrees.

3. A ferromagnetic core as in claim 2 wherein said taper angle is approximately fifteen degrees.

4. A ferromagnetic core as in claim 1 wherein:

a primary winding formed around said first leg element; and a secondary winding formed around said second leg element;

where said primary winding is adapted to be connected to a power source; and where said secondary winding is adapted to be connected to a load.

5. A ferromagnetic core having opposed pole faces defining a gap of the type adapted for use in an electromagnetic device having a source of operating flux for establishing a magnetic field in said gap, an armature mounted for selective contact with either of said pole faces, and having a source of latching flux for retaining said armature in contact with either of said pole faces, comprising:

a first member having first and second leg elements tapered in opposite directions; and a second member having first and second leg elements tapered in opposite directions;

said tapered leg elements each having a continuous tapered interface, said continuous tapered interface of said first member being oriented opposite to said continuous tapered interface of said second member, said continuous tapered interfaces adapted to cooperatively mate with a wedging action;

said first and second leg elements of said first member and said second member having a coefficient of friction with respect to each other, said continuous tapered interfaces of said first and second leg elements of said first member and said second member forming a taper angle, the value of the tangent of said taper angle being not more than the value of said coefficient of friction;

whereby low reluctance first and second legs are formed.

6. A ferromagnetic core as in claim 5 wherein said continuous tapered interfaces of said first and second leg elements of said first member and said second member form a taper angle of from greater than zero to not more than 35 degrees.

7. A ferromagnetic core as in claim 6 wherein said taper angle is approximately fifteen degrees.

* * * * *